US010724316B2

(12) United States Patent
Crowley

(10) Patent No.: US 10,724,316 B2
(45) Date of Patent: Jul. 28, 2020

(54) SHIFTING TOOL RESETTABLE DOWNHOLE

(71) Applicant: WEATHERFORD TECHNOLOGY HOLDINGS, LLC, Houston, TX (US)

(72) Inventor: Scott Crowley, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 207 days.

(21) Appl. No.: 15/602,275

(22) Filed: May 23, 2017

(65) Prior Publication Data

US 2018/0340384 A1 Nov. 29, 2018

(51) Int. Cl.

| | |
|---|---|
| ***E21B 23/00*** | (2006.01) |
| ***E21B 34/14*** | (2006.01) |
| *E21B 34/00* | (2006.01) |

(52) U.S. Cl.

CPC ..... *E21B 23/00* (2013.01); *E21B 34/14* (2013.01); *E21B 2034/007* (2013.01)

(58) Field of Classification Search

CPC ..... E21B 34/14

See application file for complete search history.

(56) References Cited

U.S. PATENT DOCUMENTS

| | | | |
|---|---|---|---|
| 4,124,070 | A | 11/1978 | King et al. |
| 4,436,152 | A | 3/1984 | Fisher, Jr. et al. |
| 5,549,161 | A | 8/1996 | Gomez et al. |
| 5,641,023 | A | 6/1997 | Ross et al. |
| 2009/0071655 | A1 | 3/2009 | Fay |
| 2017/0037706 | A1 | 2/2017 | Cho et al. |

FOREIGN PATENT DOCUMENTS

| | | | |
|---|---|---|---|
| GB | 2213181 | A | 8/1989 |
| WO | 2009/035917 | A2 | 3/2009 |
| WO | 2010/129631 | A1 | 11/2010 |

OTHER PUBLICATIONS

Specification and Drawings filed May 23, 2017 for U.S. Appl. No. 15/602,636, 29 pages.

International Search Report with Written Opinion dated Jul. 16, 2018 for PCT Patent Application No. PCT/US2018/027931, 15 pages.

(Continued)

*Primary Examiner* — D. Andrews

(74) *Attorney, Agent, or Firm* — Smith IP Services, P.C.

(57) ABSTRACT

A shifting tool can include an inner mandrel, engagement members engageable with a well tool component, and a detent device that prevents relative displacement between the inner mandrel and the engagement members, but permits such relative displacement in response to a predetermined longitudinal force. A method of operating a shifting tool can include engaging engagement members with a component of a well tool, and disengaging the engagement members from the component by applying a predetermined longitudinal force, thereby causing the engagement members to retract out of engagement with the component and then extend in the well. Another shifting tool can include a retraction sleeve, engagement members that engage a well tool component, and a detent device that prevents relative displacement between the retraction sleeve and the engagement members, but permits such relative displacement in response to a predetermined longitudinal force.

20 Claims, 5 Drawing Sheets

(56) References Cited

OTHER PUBLICATIONS

International Search Report with Written Opinion dated Jul. 16, 2018 for PCT Patent Application No. PCT/US2018/027937, 13 pages.
Office Action dated Sep. 13, 2018 for U.S. Appl. No. 15/602,636, 20 pages.
Office Action dated Apr. 26, 2019 for U.S. Appl. No. 15/602,636, 16 pages.

SHIFTING TOOL RESETTABLE DOWNHOLE

BACKGROUND

This disclosure relates generally to equipment utilized and operations performed in conjunction with subterranean wells and, in an example described below, more particularly provides a shifting tool that is resettable downhole.

Shifting tools can be used to operate or actuate a variety of different well equipment. For example, a shifting tool can be used to operate a valve (such as, a sliding sleeve valve or a ball valve) between open and closed positions.

Typically, when using a shifting tool to operate an item of well equipment, a force is applied to a component of the well equipment from the shifting tool. The force may be supplied to the shifting tool via a conveyance (such as, a wireline, slickline or coiled tubing).

Occasionally, the applied force is excessive (for example, if the component of the equipment is stuck, the equipment is damaged, etc.), and the shifting tool is disengaged from the equipment as a result. The shifting tool can then be retrieved to surface, and can be redressed if another attempt is to be made to operate the well equipment.

Thus, it will be appreciated that improvements are continually needed in the arts of designing, constructing and operating shifting tools for use in wells. The improvements may be useful with a variety of different shifting tool designs for operation of a variety of different types of well equipment.

DETAILED DESCRIPTION

Figure 1:
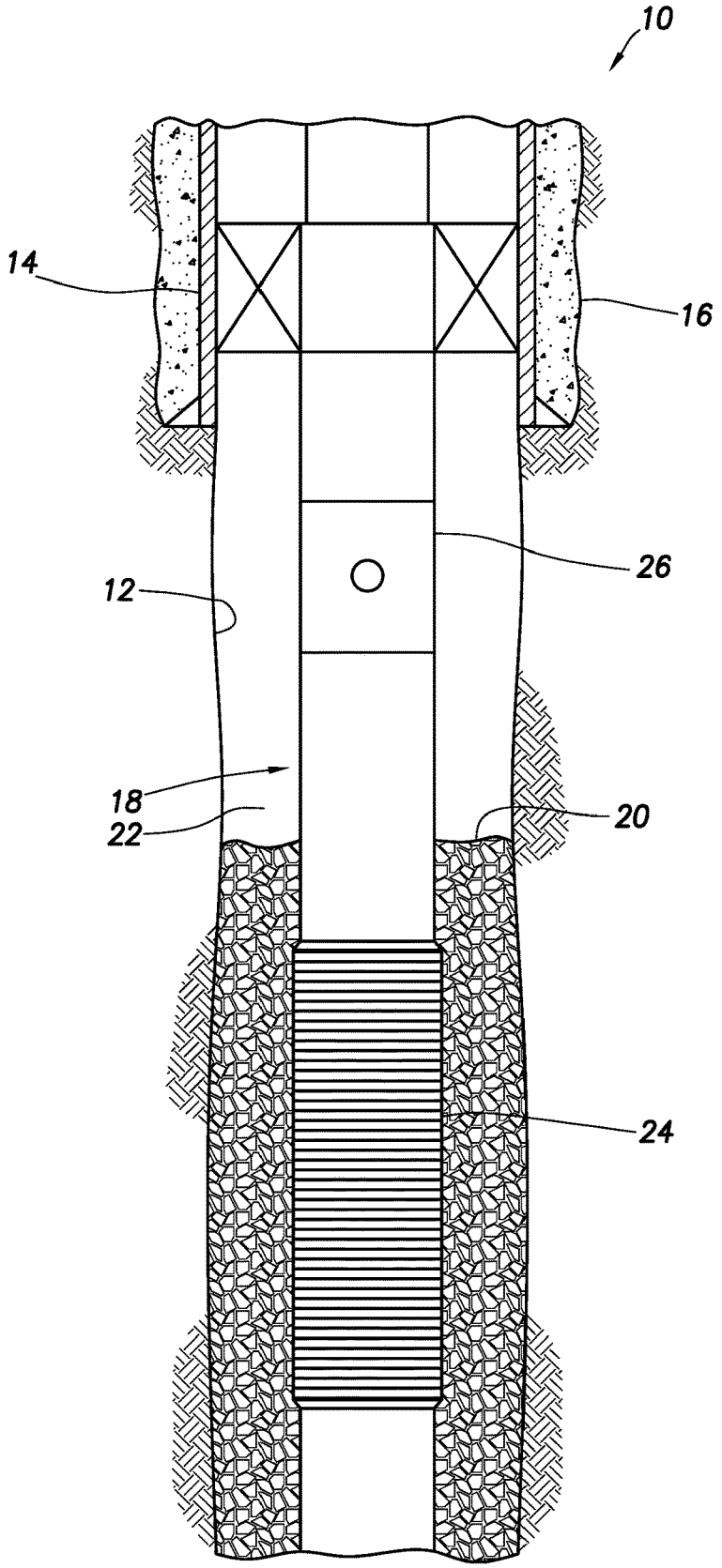
FIG. 1 is a representative partially cross-sectional view of an example of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into the earth. An upper section of the wellbore 12 (as viewed in FIG. 1) has been lined with casing 14 and cement 16, but a lower section of the wellbore remains uncased or open hole.

A completion string 18 has been installed in the wellbore 12. In this example, the completion string 18 represents a simplified gravel pack completion string that is configured for placement of gravel 20 in an annulus 22 surrounding one or more well screens 24. However, the scope of this disclosure is not limited to use of a gravel pack completion string, or to gravel packing at all.

The completion string 18 includes a well tool 26 that selectively permits and prevents flow between the annulus 22 and an interior of the completion string 18. In this example, the well tool 26 comprises a sliding sleeve valve. The well tool 26 is operated by longitudinally shifting a sliding sleeve (not visible in FIG. 1, see FIGS. 3-5) of the valve between open and closed positions.

Figure 2:
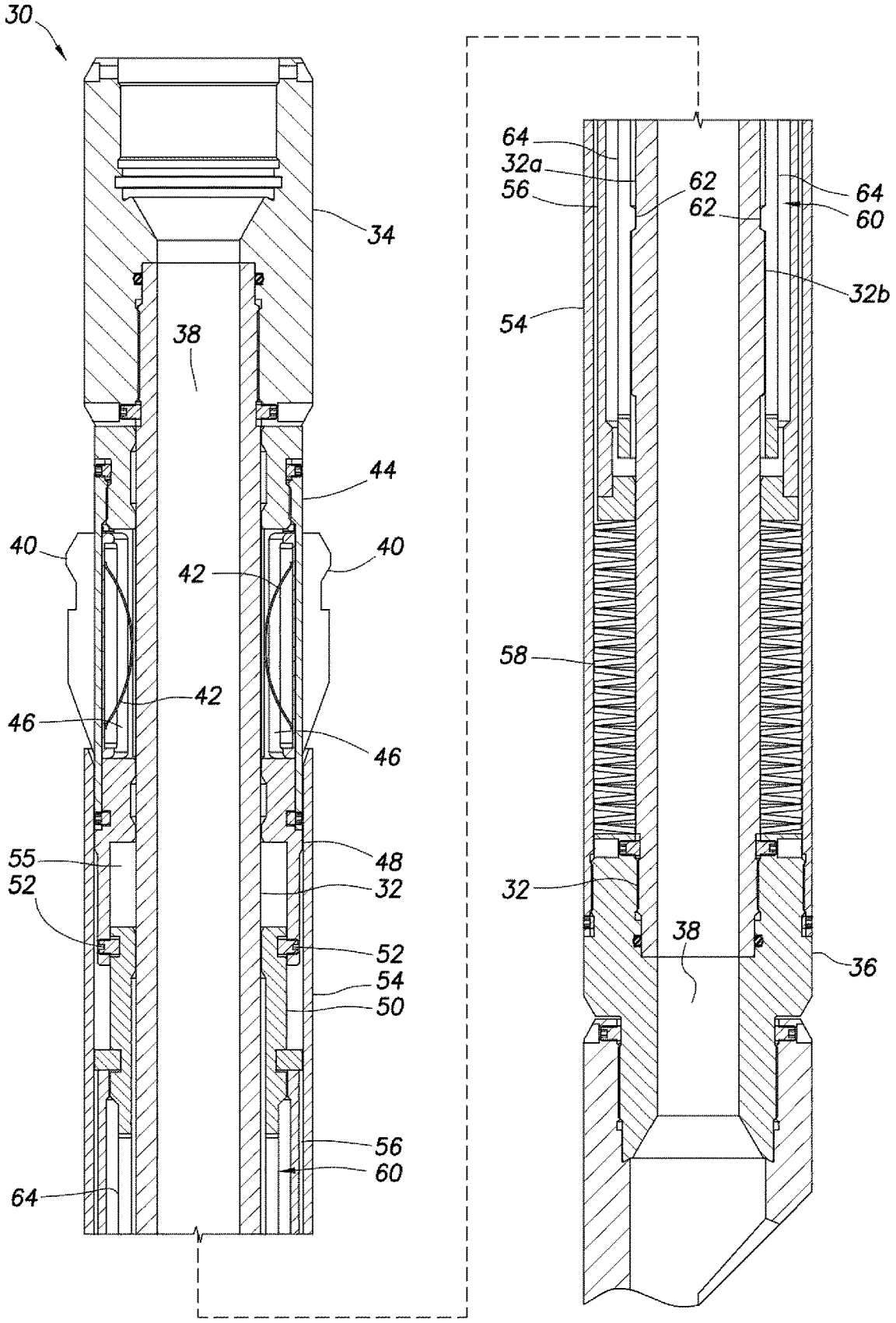
FIG. 2 is a representative partially cross-sectional view of a shifting tool that may be used in the system and method of FIG. 1, and which can embody the principles of this disclosure.

Referring additionally now to FIG. 2, an example of a shifting tool 30 is representatively illustrated. The shifting tool 30 may be used to shift the sliding sleeve of the valve (well tool 26) as described above in the system 10 and method of FIG. 1, or the shifting tool 30 may be used to shift other well tool components in other systems and methods, in keeping with the principles of this disclosure.

In the FIG. 2 example, the shifting tool 30 includes an inner generally tubular mandrel 32, with upper and lower connectors 34, 36 at opposite ends of the inner mandrel. The connectors 34, 36 facilitate connection of the shifting tool 30 to a conveyance (such as, a wireline, slickline, coiled tubing, etc.), or to other well equipment. In the FIG. 1 system 10 and method, the conveyance would be used to convey the shifting tool 30 longitudinally through the completion string 18.

A flow passage 38 extends longitudinally through the shifting tool 30. When conveyed by coiled tubing or other tubular string, the flow passage 38 is part of an inner flow passage of the tubular string. However, the flow passage 38 is optional, and it is not necessary for the inner mandrel 32 to have a tubular shape.

Circumferentially distributed about the inner mandrel 32 are engagement members 40. In this example, the engagement members 40 are of the type known to those skilled in the art as "shifting keys," in that they each have an external profile formed thereon that is shaped to complementarily engage a corresponding internal profile formed in a well tool component. Shifting keys can be used to transmit force between a shifting tool and a well tool component, in order to displace the component.

In other examples, the engagement members 40 could have other forms. A C-ring, snap ring or resilient collet could be used as a single engagement member 40 that releasably engages a well tool component. Thus, the scope of this disclosure is not limited to use of any particular number, type, shape or configuration of the engagement members 40.

The engagement members 40 are radially outwardly biased by springs 42. As depicted in FIG. 2, the engagement members 40 are outwardly extended relative to the inner mandrel 32 by the springs 42. If resilient members (such as, C-rings, snap rings, collets, etc.) are used for the engagement members 40, the springs 42 may not be used.

A retainer sleeve 44 has openings 46 therein for receiving the engagement members 40. The engagement members 40 are radially slidable in the openings 46, but relative longitudinal and rotational displacement of the engagement members 40 relative to the retainer sleeve 44 is substantially prevented.

The retainer sleeve 44 is connected to a connector 48, which is, in turn, connected to a sleeve 50 via shear screws 52. The shear screws 52 provide for a contingency release capability, in case the shifting tool 30 becomes stuck downhole. A predetermined axial load applied to the inner mandrel 32 via the upper connector 34 and a conveyance or actuator connected thereto can cause the shear screws 52 to shear, and allow the sleeve 50 to displace further into an annular cavity 55 of the connector 48.

A retraction sleeve 54 is connected to the lower connector 36 and, thus, displaces with the inner mandrel 32. When the sleeve 50 telescopes into the connector 48, the retraction sleeve 54 will displace upward (as viewed in FIG. 2), engage the engagement members 40, and displace the engagement members radially inward and out of contact with a surrounding structure (such as, the well tool 26).

A load transfer sleeve 56 transfers a compressive load between the sleeve 50 and a compression spring 58. The spring 58 continuously applies an upwardly directed (as viewed in FIG. 2) biasing force to a subassembly comprising the load transfer sleeve 56, the sleeve 50, the connector 48, the retainer sleeve 44 and the engagement members 40. This subassembly is slidable on the inner mandrel 32, but is biased upward by the spring 58. The spring 58 is depicted in FIG. 2 as comprising Bellville washers, but other types of springs may be used (such as, coiled springs, pressurized fluid chambers, elastomers, etc.).

A detent device 60 is also connected to (such as, integrally formed with) the sleeve 50. The detent device 60 prevents the inner mandrel 32 (and the connected retraction sleeve 54 and connector 36) from displacing upward relative to the subassembly mentioned above (including the engagement members 40), unless a predetermined axially upwardly directed force is applied to the inner mandrel 32.

Projections 62 formed in circumferentially distributed flexible collets 64 are initially positioned about a reduced outer diameter 32*a* of the inner mandrel 32. When the predetermined axial force is applied to the inner mandrel 32, the collets 64 will flex radially outward, until they are radially outwardly supported on an enlarged outer diameter 32*b* of the inner mandrel 32. The inner mandrel 32 will, thus, be displaced upward relative to the collets 64 and the attached subassembly (the load transfer sleeve 56, the sleeve 50, the connector 48, the retainer sleeve 44 and the engagement members 40), when the predetermined axial force is applied to the inner mandrel 32.

In FIG. 2, the shifting tool 30 is in a run-in configuration, in which the shifting tool can be conveyed into a well and engaged with a well tool (such as the well tool 26 or another type of well tool) to shift a component of the well tool. In this configuration, the engagement members 40 are extended.

A conveyance (such as, a wireline, slickline or tubing) would be connected to one or both of the end connectors 34, 36 to convey the shifting tool 32 into the well, and to apply longitudinal force to the well tool component. The longitudinal force can be applied in either longitudinal direction, and can be applied by slacking off or applying tension to the conveyance at surface, by activating a downhole actuator to apply the force, or by another technique. The scope of this disclosure is not limited to any particular technique for conveying the shifting tool 30 in a well, or for applying longitudinal force to the shifting tool.

Figure 3:
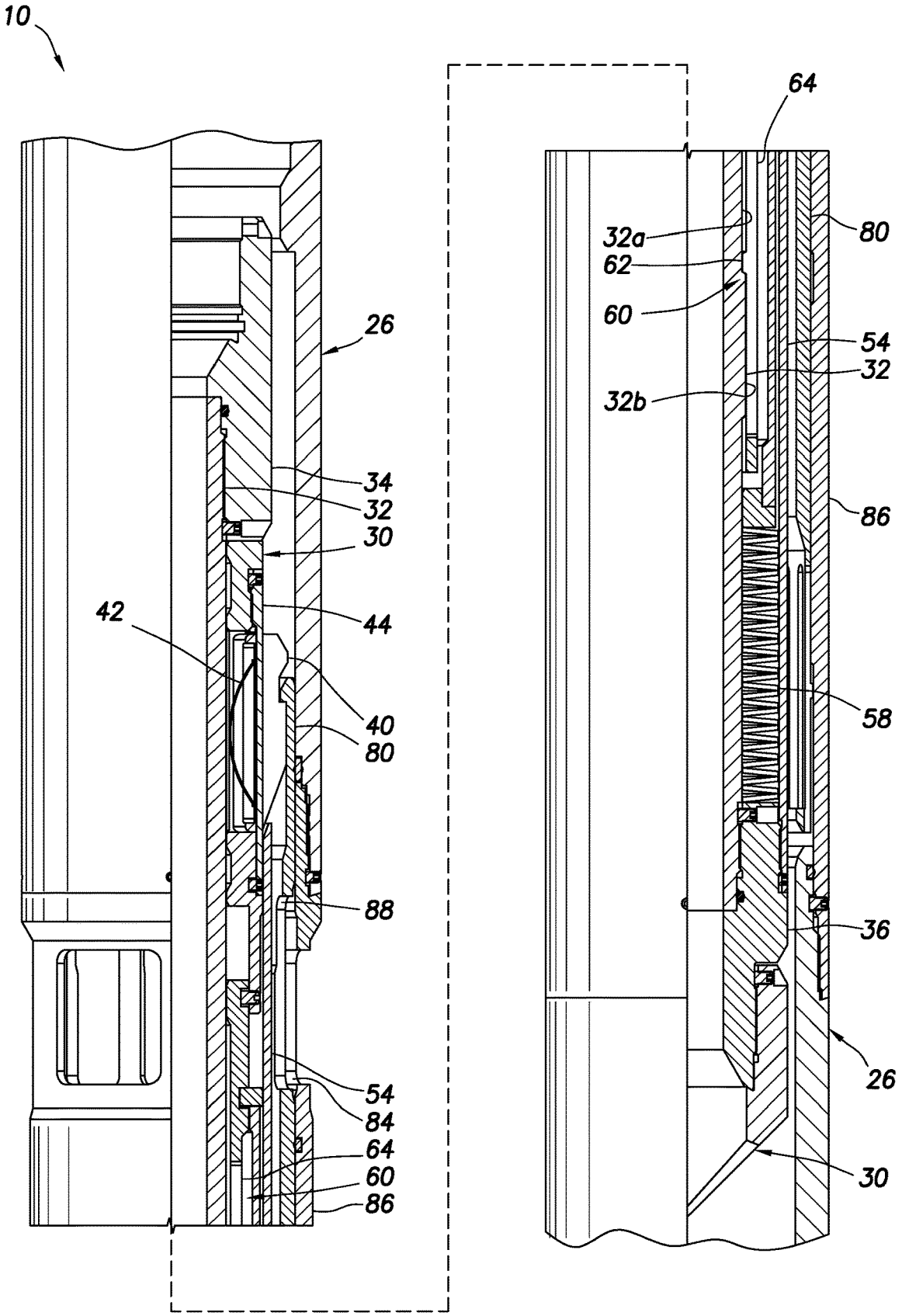
FIGS. 3-5 are representative partially cross-sectional views of various shifting tool operational configurations.
Figure 4:
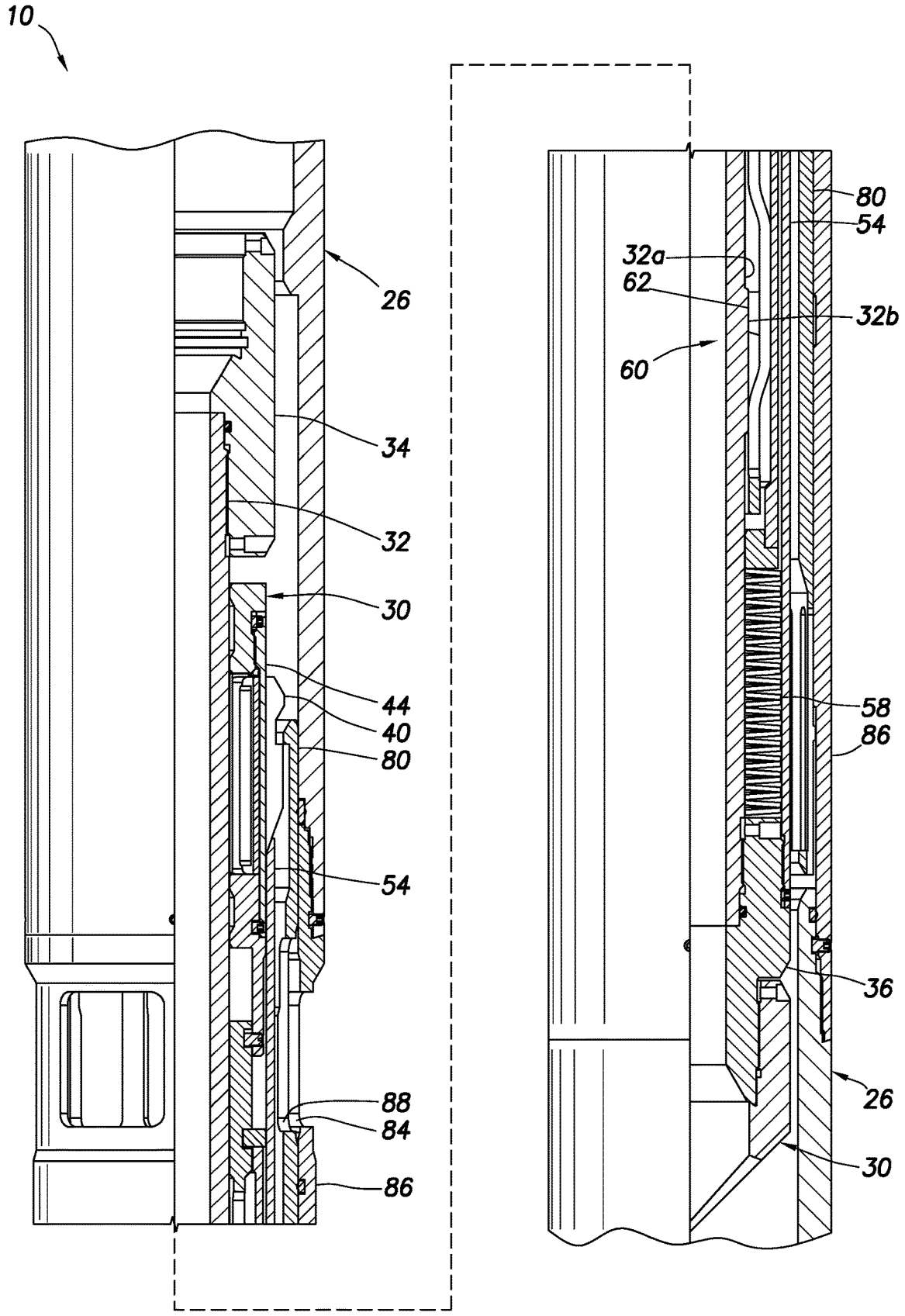
Figure 5:
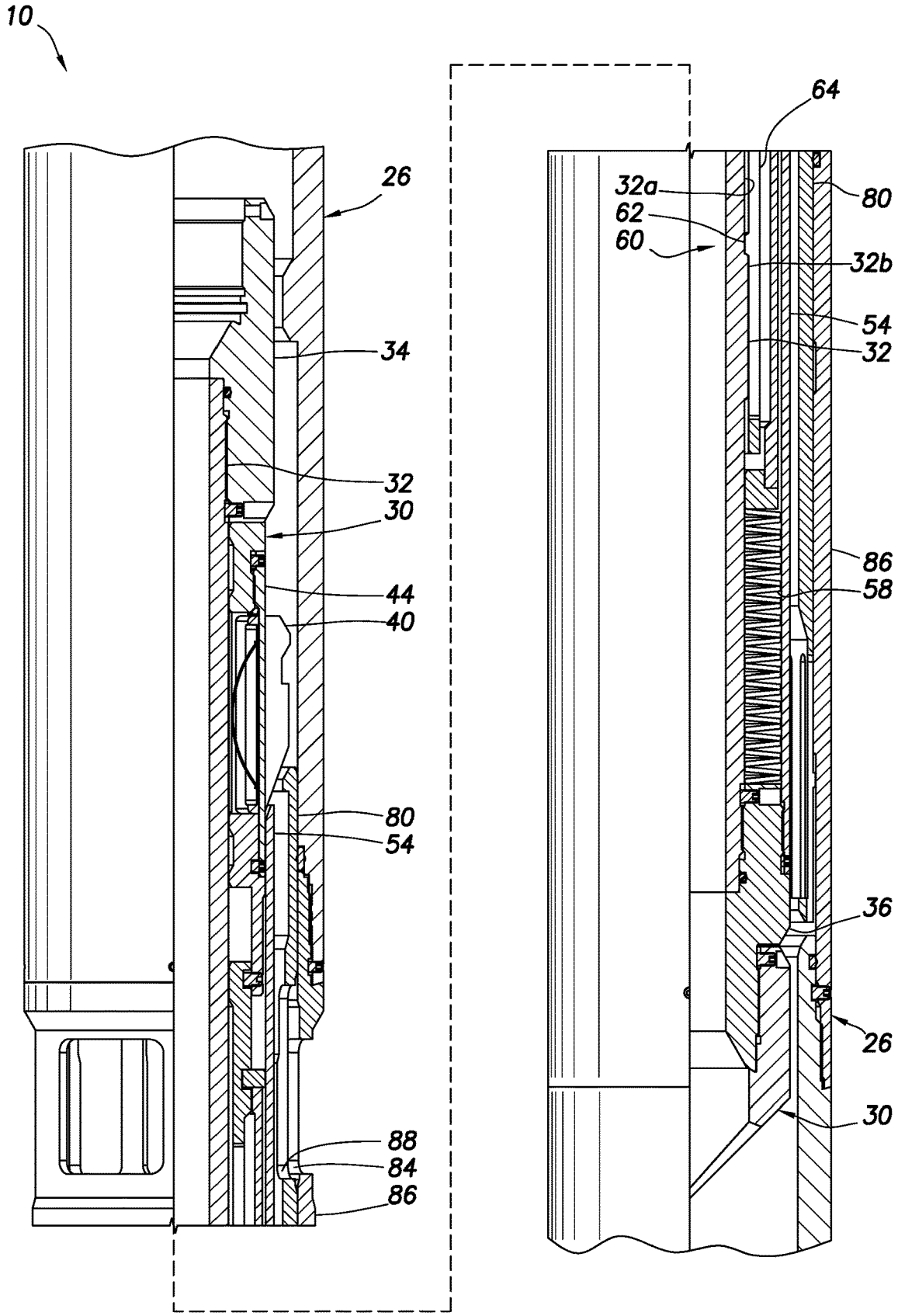

Referring additionally now to FIGS. 3-5, various stages in operation of the shifting tool 30 are representatively illustrated. The shifting tool 30 is depicted as being used to shift a component 80 of the well tool 26 in the system 10 and method of FIG. 1. However, the scope of this disclosure is not limited to shifting of any particular type of well tool component in any particular system or method.

In the FIGS. 3-5 example, the component 80 is a sliding sleeve that is used to selectively permit or prevent flow through openings 84 formed through a sidewall of an outer housing 86 of the well tool 26. As depicted in FIG. 3, the component 80 is in a lower, open position, in which flow is permitted through the openings 84 (due to the openings 84 being aligned with openings 88 formed through the component 80).

The shifting tool 30 has been engaged with the well tool component 80 by engaging the engagement members 40 with an upper section of the component 80 having a suitable internal profile formed therein. To shift the component 80 upward (as viewed in FIG. 3) to a closed position, a longitudinal force is applied from the engagement members 40 to the component 80, for example, by lifting on the inner mandrel 32 via the conveyance used to position the shifting tool 30 in the well tool 26.

As depicted in FIG. 4, the longitudinal force has been applied, thereby causing the spring 58 to be compressed. However, the attempt to shift the component 80 upward was unsuccessful. An additional amount of longitudinal force was then applied, with the additional force being sufficient (greater than or equal to a predetermined level) to cause the collets 64 to flex outward and then be radially supported on the enlarged outer diameter 32*b* as the inner mandrel 32 displaces upward relative to the subassembly including the engagement members 40.

Note that, at this point, the engagement members 40 remain in the same position as in FIG. 3, but the inner mandrel 32 has displaced upward relative to the engagement members. Since the retraction sleeve 54 is rigidly connected to the inner mandrel 32 (via the connector 36), the retraction sleeve is also displaced upward relative to the engagement members 40. This upward displacement of the retraction sleeve 54 relative to the engagement members 40 causes the engagement members to be retracted radially inward relative to the well tool component 80, so that the engagement members disengage from the well tool component.

As depicted in FIG. 5, the engagement members 40 are completely disengaged from the well tool component 80. The spring 58 has displaced the subassembly (the load transfer sleeve 56, the sleeve 50, the connector 48, the retainer sleeve 44 and the engagement members 40) upward relative to the inner mandrel 32.

The retraction sleeve 54 no longer retracts the engagement members 40, and so the engagement members are displaced radially outward to their extended positions. The projections 62 on the collets 64 are again engaged with the reduced outer diameter 32*a* on the inner mandrel 32, and so the subassembly is again releasably retained in the FIG. 5 configuration, with the engagement members 40 in their extended positions.

Note that this FIG. 5 configuration is essentially the same as the run-in configuration of FIG. 2. Thus, the shifting tool 30 has been effectively "reset" downhole.

The shifting tool 30 can now be used in a further attempt to shift the well tool component 80 by again engaging the engagement members 40 with the component 80 and applying an upwardly directed longitudinal force to the shifting tool 30. If this further attempt is unsuccessful, the technique described above can be used to again reset the shifting tool 30 downhole (e.g., apply the predetermined longitudinal force to the shifting tool 30 to cause the detent device 60 to permit upward displacement of the inner mandrel 32 relative to the engagement members 40). Any number of resets can be accomplished downhole, without a need to retrieve the shifting tool 30 to surface.

It may now be fully appreciated that the above disclosure provides significant advancements to the arts of designing, constructing and operating shifting tools for use in wells. In one example described above, the shifting tool 30 can be reset downhole after an unsuccessful attempt to shift a well tool component 80. The setting tool 30 can also be reset downhole after a successful attempt to shift the well tool component 80.

The above disclosure provides to the arts a shifting tool 30 for use in a subterranean well. In one example, the shifting tool 30 can include an inner mandrel 32, one or more engagement members 40 arranged on the inner mandrel 32 and configured to engage a well tool component 80, and a detent device 60 that prevents relative displacement between the inner mandrel 32 and the engagement members 40, but permits relative displacement between the inner mandrel 32 and the engagement members 40 in response to a predetermined longitudinal force applied to the inner mandrel 32.

The detent device 60 may include at least one resilient collet 64. The collet 64 may engage an outer surface (such as, outer diameters 32*a, b*) of the inner mandrel 32. A projection 62 on the collet 64 may engage an enlarged outer diameter 32*b* on the inner mandrel 32 in response to the predetermined longitudinal force applied to the inner mandrel 32.

The shifting tool 30 may include a retraction sleeve 54 connected to the inner mandrel 32. The retraction sleeve 54 may inwardly displace the engagement members 40 in response to the predetermined longitudinal force applied to the inner mandrel 32.

The shifting tool 30 may include a spring 58 that compresses in response to the predetermined longitudinal force applied to the inner mandrel 32. The spring 58 may bias the engagement members 40 to displace relative to the inner mandrel 32.

The above disclosure also provides to the arts a method of operating a shifting tool 30 in a subterranean well. In one example, the method can include conveying the shifting tool 30 into a well tool 26 in the well, engaging one or more engagement members 40 of the shifting tool 30 with a component 80 of the well tool 26, and disengaging the engagement members 40 from the well tool component 80 by applying a predetermined longitudinal force to the shifting tool 30, thereby causing the engagement members 40 to retract out of engagement with the well tool component 80 and then extend in the well.

The step of causing the engagement members 40 to retract may comprise longitudinally compressing a spring 58, thereby increasing a biasing force that biases the engagement members 40 to displace longitudinally relative to an inner mandrel 32 of the shifting tool 30.

The step of causing the engagement members 40 to retract may comprise activating a detent device 60 that releasably secures against relative longitudinal displacement between the engagement members 40 and an inner mandrel 32 of the shifting tool 30.

The step of activating the detent device 60 may comprise deflecting a resilient collet 64 of the detent device 60. The step of deflecting the resilient collet 64 may comprise engaging an enlarged outer diameter 32*b* on the inner mandrel 32.

The step of causing the engagement members 40 to retract may comprise displacing a retraction sleeve 54 relative to the engagement members 40, so that the engagement members 40 are received at least partially in the retraction sleeve 54. The step of causing the engagement members 40 to extend in the well may comprise a spring 58 displacing the retraction sleeve 54 relative to the engagement members 40.

Also provided to the arts by the above disclosure is a shifting tool 30 for use in displacing a component 80 of a well tool 26. In this example, the shifting tool 30 can include a retraction sleeve 54, one or more engagement members 40 configured to engage the well tool component 80, and a detent device 60 that prevents relative displacement between the retraction sleeve 54 and the engagement members 40, but permits relative displacement between the retraction sleeve 54 and the engagement members 40 in response to a predetermined longitudinal force applied to the shifting tool 30.

The retraction sleeve 54 may inwardly displace the engagement members 40 in response to the predetermined longitudinal force applied to the shifting tool 30.

The shifting tool 30 may include a spring 58 that compresses in response to the predetermined longitudinal force applied to the shifting tool 30. The spring 58 may bias the engagement members 40 to displace relative to the retraction sleeve 54.

The detent device 60 may include at least one resilient collet 64. The collet 64 may engage an outer surface of an inner mandrel 32 of the shifting tool 30. A projection 62 on the collet 64 may engage an enlarged outer diameter 32*b* on the inner mandrel 32 in response to the predetermined longitudinal force applied to the shifting tool 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A shifting tool for use in a subterranean well, the shifting tool comprising:

an inner mandrel;

one or more engagement members arranged on the inner mandrel and configured to engage a well tool component; and a detent device that prevents any prior relative longitudinal displacement between the inner mandrel and the engagement members until a predetermined longitudinal force is applied to the shifting tool, but permits relative displacement between the inner mandrel and the engagement members in response to the predetermined longitudinal force applied to the inner mandrel, and in which the shifting tool is configured to reset downhole following application of the predetermined longitudinal force, whereby the shifting tool is reusable downhole without retrieving the shifting tool from the well.

2. The shifting tool of claim 1, in which the detent device includes at least one resilient collet.

3. The shifting tool of claim 2, in which the collet engages an outer surface of the inner mandrel.

4. The shifting tool of claim 2, in which a projection on the collet engages an enlarged outer diameter on the inner mandrel in response to the predetermined longitudinal force applied to the inner mandrel.

5. The shifting tool of claim 2, further comprising a retraction sleeve connected to the inner mandrel.

6. The shifting tool of claim 5, in which the retraction sleeve inwardly displaces the engagement members in response to the predetermined longitudinal force applied to the inner mandrel.

7. The shifting tool of claim 1, further comprising a spring that compresses in response to the predetermined longitudinal force applied to the inner mandrel, and that biases the engagement members to displace relative to the inner mandrel.

8. A method of operating a shifting tool in a subterranean well, the method comprising:

conveying the shifting tool into a well tool in the well;

engaging one or more engagement members of the shifting tool with a component of the well tool, in which a detent device prevents any prior relative longitudinal displacement between the engagement members and an inner mandrel of the shifting tool until a predetermined longitudinal force is applied to the shifting tool; and disengaging the engagement members from the well tool component by applying the predetermined longitudinal force to the shifting tool, thereby causing the engagement members to retract out of engagement with the well tool component and then extend while the shifting tool is downhole in the well.

9. The method of claim 8, in which causing the engagement members to retract comprises longitudinally compressing a spring, thereby increasing a biasing force that biases the engagement members to displace longitudinally relative to the inner mandrel.

10. The method of claim 8, in which causing the engagement members to retract comprises activating the detent device.

11. The method of claim 10, in which activating the detent device comprises deflecting a resilient collet of the detent device.

12. The method of claim 11, in which deflecting the resilient collet comprises engaging an enlarged outer diameter on the inner mandrel.

13. The method of claim 8, in which causing the engagement members to retract comprises displacing a retraction sleeve relative to the engagement members, so that the engagement members are received at least partially in the retraction sleeve.

14. The method of claim 13, in which causing the engagement members to extend in the well comprises a spring displacing the retraction sleeve relative to the engagement members.

15. A shifting tool for use in displacing a component of a well tool, the shifting tool comprising:

a retraction sleeve;

one or more engagement members configured to engage the well tool component; and a detent device that prevents any prior relative longitudinal displacement between the retraction sleeve and the engagement members until a predetermined longitudinal force is applied to the shifting tool, but permits relative displacement between the retraction sleeve and the engagement members in response to the predetermined longitudinal force applied to the shifting tool, and in which the shifting tool is configured to reset downhole following application of the predetermined longitudinal force, whereby the shifting tool is reusable downhole without retrieving the shifting tool to surface.

16. The shifting tool of claim 15, in which the retraction sleeve inwardly displaces the engagement members in response to the predetermined longitudinal force applied to the shifting tool.

17. The shifting tool of claim 15, further comprising a spring that compresses in response to the predetermined longitudinal force applied to the shifting tool, and that biases the engagement members to displace relative to the retraction sleeve.

18. The shifting tool of claim 15, in which the detent device includes at least one resilient collet.

19. The shifting tool of claim 18, in which the collet engages an outer surface of an inner mandrel of the shifting tool.

20. The shifting tool of claim 19, in which a projection on the collet engages an enlarged outer diameter on the inner mandrel in response to the predetermined longitudinal force applied to the shifting tool.

* * * * *